United States Patent [19]

Huggins et al.

[11] 3,986,549

[45] Oct. 19, 1976

[54] HEAT EXCHANGER

[75] Inventors: Homer D. Huggins; Dennis C. Granetzke, both of Racine, Wis.

[73] Assignee: Modine Manufacturing Company, Racine, Wis.

[22] Filed: July 14, 1975

[21] Appl. No.: 595,623

[52] U.S. Cl. ..... 165/82; 165/157; 165/166

[51] Int. Cl.[2] ..... F28F 3/10

[58] Field of Search ..... 220/23.4, 81 R, 1.5, 220/84, 378; 206/504, 505–507, 511, 512, 515; 165/82–83, 157, 166, 165

[56] References Cited

UNITED STATES PATENTS

| | | | |
|---|---|---|---|
| 1,780,294 | 11/1930 | Davis, Jr. | 165/82 |
| 2,064,928 | 12/1936 | Lewis | 165/157 X |
| 2,656,157 | 10/1953 | Wasielewski | 165/174 X |
| 2,746,824 | 5/1956 | Bond | 220/15 X |
| 2,869,835 | 1/1959 | Butt | 165/157 X |
| 2,951,613 | 9/1960 | Hardigg | 220/81 R |
| 3,451,452 | 6/1969 | Marshall et al. | 220/84 X |
| 3,877,519 | 4/1975 | Tramuta | 165/166 |

*Primary Examiner*—Charles J. Myhre
*Assistant Examiner*—Theophil W. Streule, Jr.
*Attorney, Agent, or Firm*—Wegner, Stellman, McCord, Wiles & Wood

[57] ABSTRACT

A heat exchanger for exchanging heat between first and second gases such as for preheating the inlet air to a gas heating unit from exhaust air in which the exchanger comprises a core unit of a stack of generally planar serpentine fins each defining side-by-side gas flow passages between the adjacent side portions of the fins and means for mounting the stack of fins with some of these passages extending in one direction for a first gas and others of the passages extending generally transversely to the first gas passages for flow of the second gas in heat exchange relationship with the first gas, resilient gaskets at the edges of the unit for resiliently mounting the unit for yielding compensation for thermal dimensional changes and for sealing the gases from each other, a frame in which the unit is positioned with the frame comprising edge members engaging and bearing against the edge gaskets to apply pressure thereto and clamps for drawing the frame members together and toward the core unit to provide a rigid frame structure, clamp the frame members to the gaskets and clamp the gaskets to the edges of the core unit. The disclosure also includes a heat exchanger in which a plurality of the core units are mounted in spaced relationship to define the first and second gas flow paths through the unit and removable panels partially defining these flow paths with the panels thereby providing access to the spaces between the plurality of units for cleaning these spaces and the units themselves to keep them clear of foreign material that may be carried or deposited therein by the flowing gases.

9 Claims, 9 Drawing Figures

40
40
41
10
10
39
43
43
31
31
10
31
31
10
39
42

31
31
10
31
31
31

31
38
31
37

31

HEAT EXCHANGER

BACKGROUND OF THE INVENTION

The heat exchangers of this invention are essentially cross flow exchangers for the exchange of heat between two or more flowing gases directed in separate paths through the heat exchanger. This invention provides an improved structure for mounting each core unit of a heat exchanger in a supporting frame and for mounting a plurality of the core units in spaced relationship with each other and for providing access to the units and to the spaces therebetween for clean-out purposes.

Cross flow heat exchangers are, of course, generally well known in the prior art. Representative patents disclosing this type of heat exchanger generally are U.S. Pat. Nos. 2,539,870 and 3,780,800. Similarly, the resilient mounting of the heat exchanger core units is also generally known with typical prior U.S. Pat. Nos. including 2,500,771; 3,775,972 and 3,858,291. However, the heat exchanger structure of this invention has numerous advantages over the structures of the prior art as brought out by the inventions covered in the claims and described herein.

DESCRIPTION OF THE PREFERRED EMBODIMENTS

Figure 1:
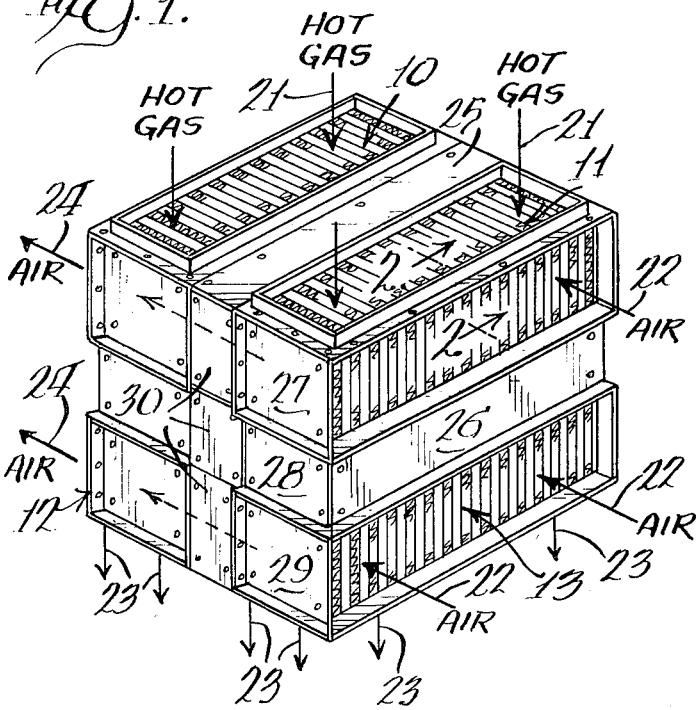
FIG. 1 is a perspective view of the heat exchanger assembly of core units illustrating one embodiment of the invention.
Figure 3:
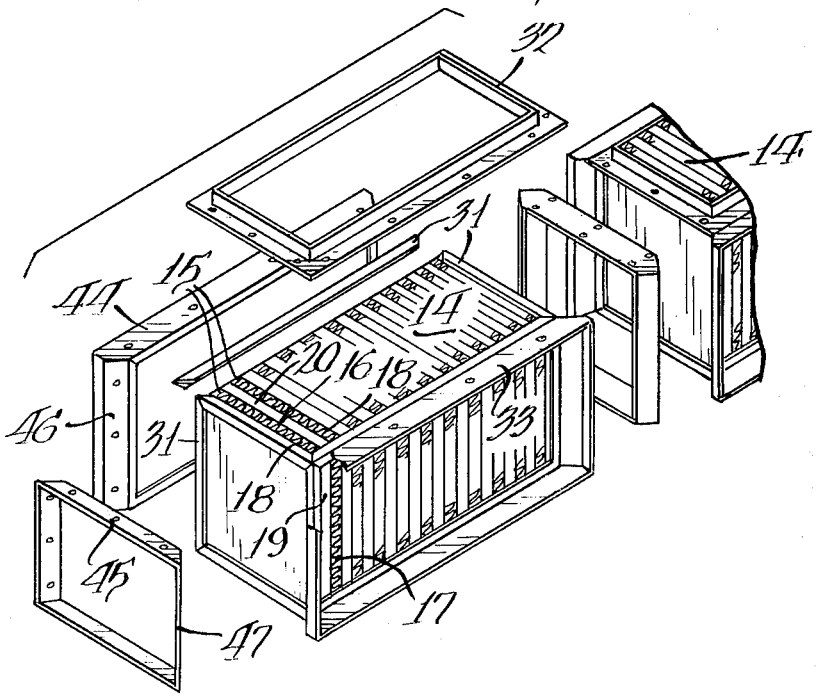
FIG. 3 is a perspective exploded view of an assembly of two core units and a supporting frame structure for mounting the core units in end-to-end relationship.

In the embodiment of FIG. 1 the heat exchanger illustrated comprises four core units 10, 11, 12 and 13 with each of the core units comprising a stack of serpentine fins as illustrated at 15 and 16 in the core unit 14 of the FIG. 3 embodiment. These serpentine fins 15 and 16 are generally planar and are arranged in the illustrated embodiment in vertical position with the spaces 17 and 18 defined by the serpentine structure comprising side-by-side gas flow passages. The outermost sides of the fins 19 and 20 define the corresponding sides of the core units 10–14.

As can be seen in the unit 14 in FIG. 3, the gas passages 17 and 18 extending in transverse directions which in the embodiment of FIG. 3 is vertically for the passages 18 and horizontally for the passages 17. Thus as illustrated in FIG. 1 by the arrows to which the legends are applied the vertical passages 18 are used, for example, for the hot gas 21 as from a furnace exhaust while the horizontal passages 17 are used for the make-up air 22 supplied to the furnace so that there is a gas-to-gas heat interchange with the result that the exhaust gas 23 is cooled while the make-up air exhausted from the unit as illustrated at 24 is preheated.

Figure 2:
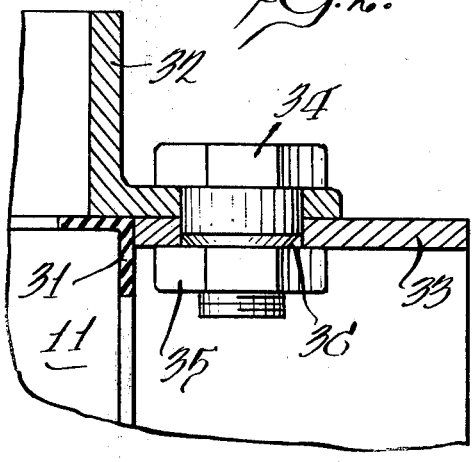
FIG. 2 is an enlarged sectional view taken substantially along line 2—2 of FIG. 1 illustrating the clamp means that may be used in the invention.

Various means for mounting the units in assembled relationship in a supporting frame are shown in the embodiments in the accompanying drawings. Thus in the embodiment of FIGS. 1 and 2 the four units 10–13 are mounted in spaced relationship with the spaces between the units being defined by removable panels 25, 26, 27, 28, 29 and 30. Each unit as illustrated at 11 in FIG. 2 is held in a supporting frame which bears against edge gaskets 31 which are held against the edge of the unit 11 by portions 32 and 33 that are clamped together and to the adjacent edge gasket 31 by clamp means illustrated by the tapered clamping bolt 34 that extends through aligned openings in the frame portions 32 and 33 and engages a nut 35. The tapered surface 36 on the bolt aids in aligning the openings through which the bolt extends in inserting the bolt in position.

Figure 5:
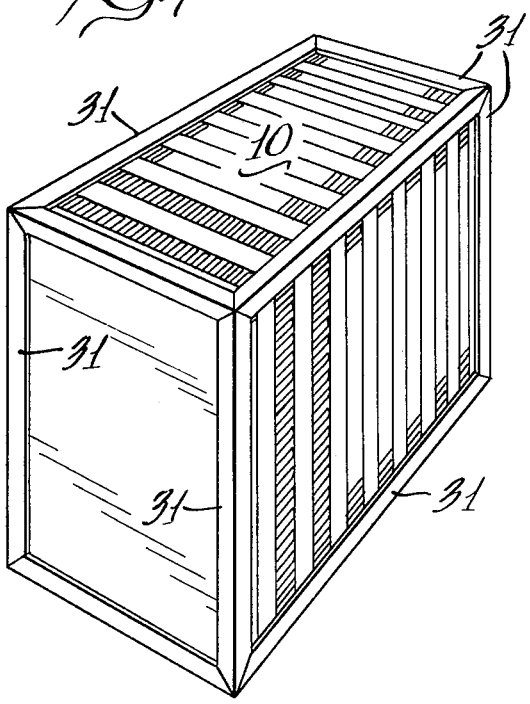
FIG. 5 is a perspective view of a core unit with resilient gaskets at the edges thereof.
Figure 6:
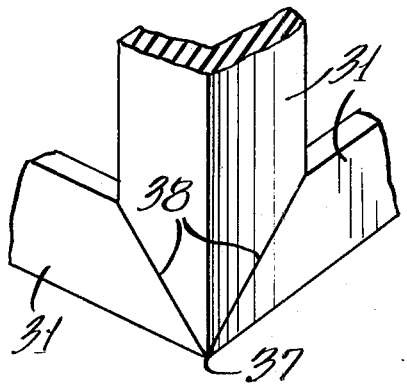
FIG. 6 is an enlarged fragmentary perspective view of a corner of FIG. 5.
Figure 7:
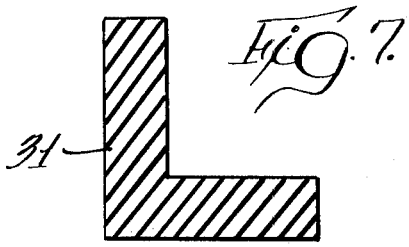
FIG. 7 is an enlarged sectional view through a gasket embodiment.

FIGS. 5–7 illustrate the gasket embodiment that may be used on the corners of the core units illustrated at 10. These edge gaskets 31 are positioned on all edges of the rectangular unit and are preferably of silicone rubber and have a generally right angled cross section as shown in FIG. 7. At the corners 37 of the structure, as illustrated in FIG. 6, the ends of the gasket strips are mitered and abutting, as illustrated at 38, in order to provide a tight joint and a secure seal between the flowing streams of gases.

Figure 4:
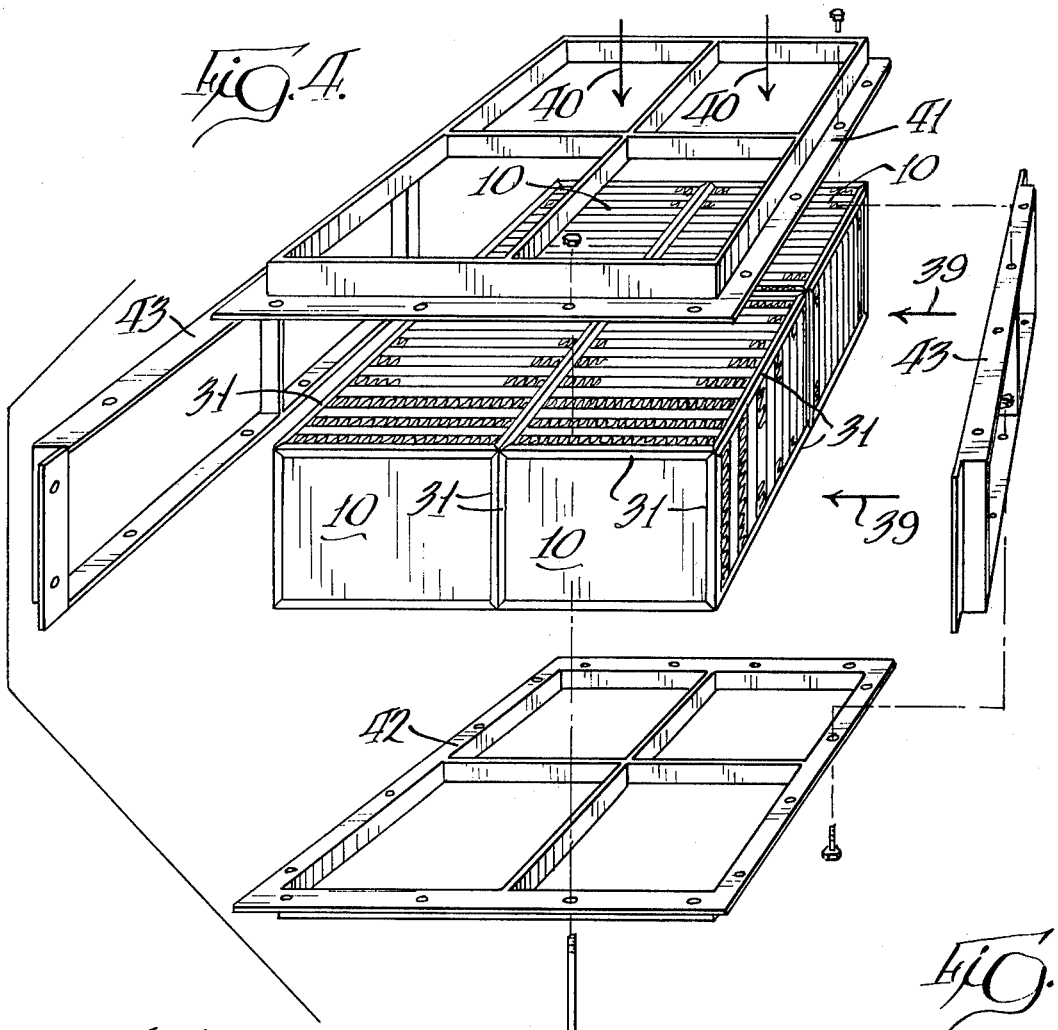
FIG. 4 is a perspective view of an assembly of core units and a supporting frame in exploded perspective.

As is illustrated in FIG. 4, the core units 10, for example, are arranged side-by-side in a rectangular structure so that the two units in two pairs are also arranged end-to-end. In this embodiment of FIG. 4, the make-up air stream 39 which is to be preheated passes sideways through the assembly so that it flows through two units in succession while the hot gas 40 used to preheat the air 39 passes in parallel through the four units.

In this embodiment the assembly of heat exchanger core units 10 is held in a supporting frame shown in exploded view with the frame comprising top and bottom members 41 and 42 and side members 43 that are bolted together as illustrated in FIG. 2 by bolts 34. This serves to clamp the frame members 41–43 against the edge gaskets 31 and the gaskets against the edges of the core units.

As illustrated in the embodiment of FIG. 3 the side 44 and end 45 frame members may be provided with tapered 46 and 47 engaging surfaces with the result that as these members are drawn together by bolts of the type of bolts 34 in FIG. 2 these sliding surfaces provide a leverage effect to apply compression forces to the edge gaskets 31 on the core unit illustrated at 14, thereby pressing them firmly against the corresponding edges of the core unit to retain the unit in a "floating" mounting which not only compensates for thermal changes but also provides a more effective seal between the separated gas streams illustrated at 21 and 22 in FIG. 1.

Thus the gasketing arrangement of this invention permits each heat exchange core unit 10–14, for example, to "float" in its supporting frame and compensate for differences in thermal dimension changes in both the core units and the frame. This change can be considerable such as when the heat exchanger core units are constructed principally of aluminum while the supporting frame 41–43 is constructed of steel. The differences in thermal expansion coefficients between these two metals is almost 100%, so that the actual extent of expansion changes where the inlet gas, for example, is 400° F. and the make-up air is 30° F. and the assembly of four units as in the FIG. 4 embodiment is 10 feet long to be compensated for is quite large.

Figure 8:
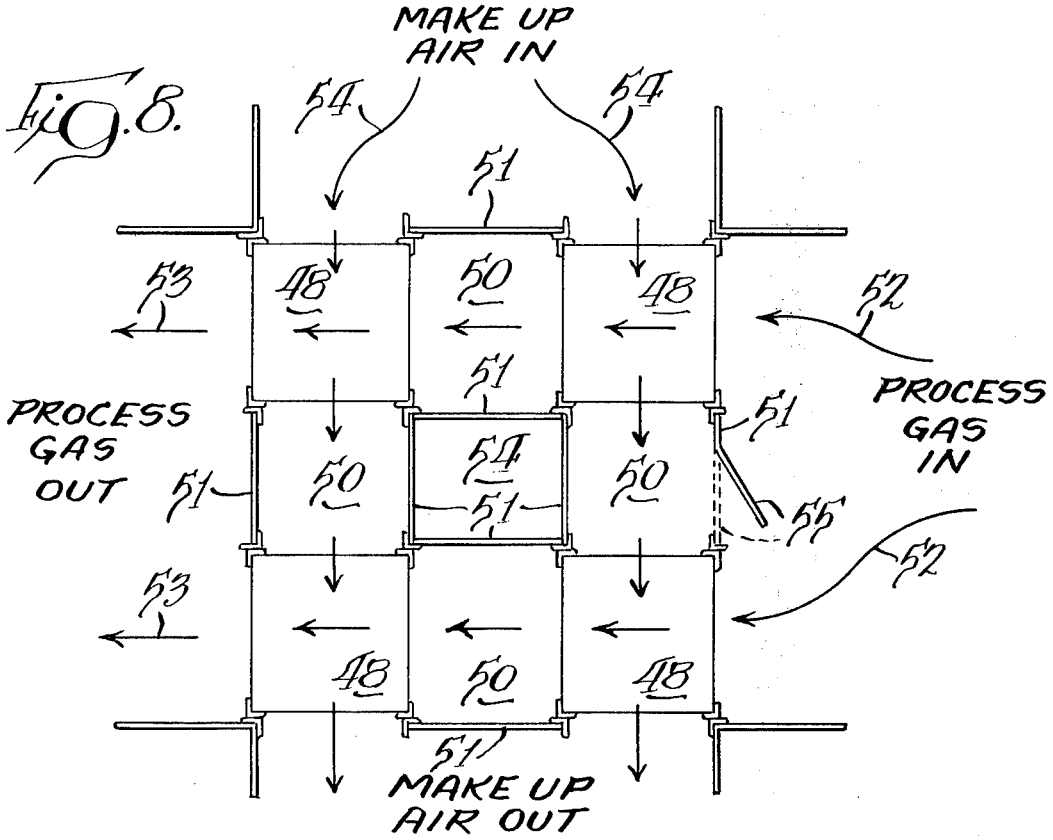
FIG. 8 is a schematic view illustrating one embodiment of an assembly of four spaced core units, a supporting frame and the gas paths of the two gases through the assembly.
Figure 9:
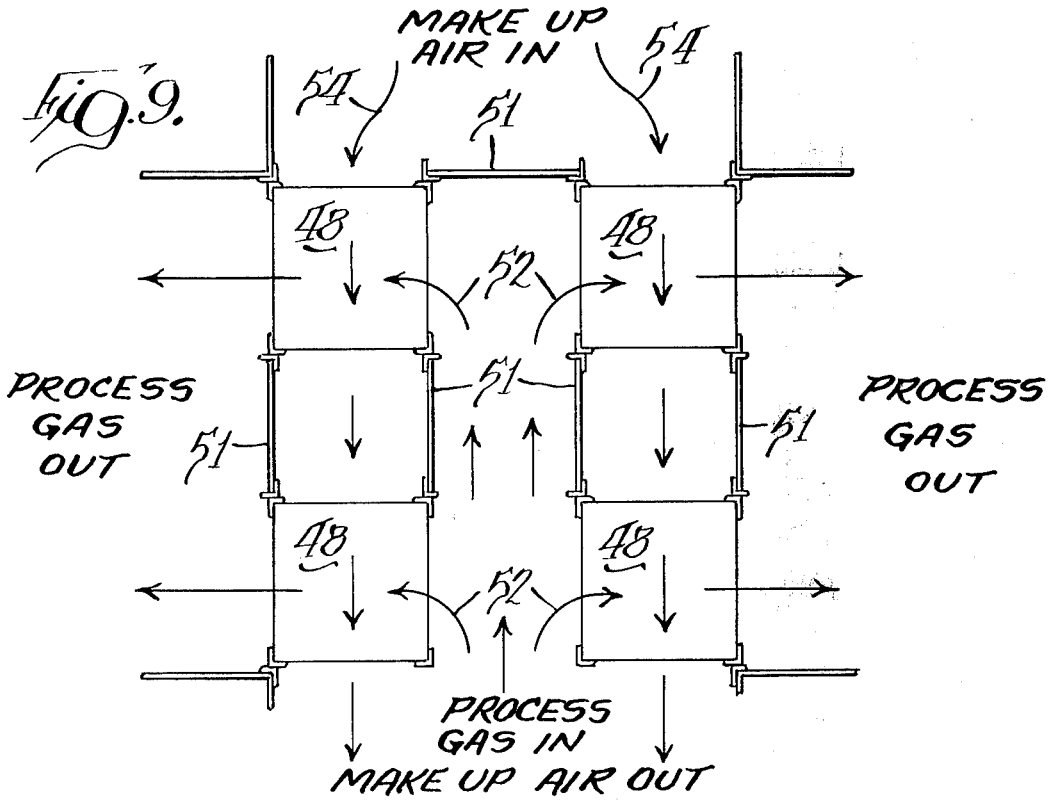
FIG. 9 is a view similar to FIG. 8 but illustrating another embodiment of the assembly.

Two embodiments of arranging for flow patterns are illustrated in FIGS. 8 and 9. In FIG. 8 the four heat exchanger core units illustrated schematically at 48 are held in spaced arrangement within a supporting frame 49 and suitably gasketed at the edges by gaskets 31, as described earlier, are provided with intermediate chambers 50 between the units and removable panels 51 associated with the core units 48 and defining the separating chambers 50. With the arrangement illustrated in FIG. 8 the hot gas 52 is divided into two streams and passes in series through a top core unit 48, then an intervening chamber 50 and then through the second unit 48 where it exits from the assembly as illustrated at 53. The make-up air 54 which is preheated by the hot gas 52 is also divided into two streams and passes in series through the assembly of units 48 and chambers 50 but transversely to the direction of flow of the hot gas 52. As an aid in separating these two gas streams for gas-to-gas heat interchange, there is also provided an intermediate chamber 54 at the center of the assembly defined in its entirety by panels 51.

When two or more separated heat exchanger units 48 are placed in series, as is the case with the units 48 of FIG. 8, there is a tendency for contaminants carried by the gas streams to be trapped within and between the units. The large spaces or chambers 50 and 51 that are provided between the units 48 permit a workman to have access to these chambers for clean-out purposes. In fact, in extremely large installations an outer panel 51 may be provided with a hinged door as illustrated at 55 in open position in solid lines and in closed position in dotted lines so as to aid this access.

FIG. 9 is similar to FIG. 8 but illustrates how the routes of the hot gas 52 and the make-up air 54 may be changed by proper arrangement of the panels 51. This arrangement permits the hot gas to enter through the center of the unit and to be diverted laterally in two opposite directions so that this gas passes through only one core unit 48 and not in series through two and an intervening chamber 50 as in FIG. 8. The passage for the make-up air 54 in this FIG. 9 is essentially the same as in FIG. 8.

Having described our invention as related to the embodiments shown in the accompanying drawings, it is our intention that the invention be not limited by any of the details of description, unless otherwise specified, but rather be construed broadly within its spirit and scope as set out in the appended claims.

We claim:

1. A gas-to-gas heat exchanger for exchanging heat between separate first and second gases of widely varying temperatures, comprising: a generally rectangular core unit comprising a stack of serpentine fins each defining side-by-side gas flow passages and means for mounting said fins with some of said fin passages extending in one direction for the first gas and others of said fin passages extending transversely to said first gas passages for the second gas; resilient gaskets at the edges of said unit both for resiliently mounting the unit for compensation for thermal dimensional changes and also for sealing the gases from each other in their flows through the unit; a frame in which said unit is positioned, the frame comprising edge members engaging and bearing against said edge gaskets to apply pressure thereto; and clamp means for drawing said frame members toward each other and said core unit to clamp the frame members to the gaskets and the gaskets to said edges of the core unit.

2. The heat exchanger of claim 1 wherein said passages for said first and second gases are arranged at right angles to each other.

3. The heat exchanger of claim 1 wherein at least one of said gases is at a high temperature and said gaskets comprise a high temperature resistant polymer.

4. The heat exchanger of claim 1 wherein said passages for said first and second gases are arranged at right angles to each other, at least one of said gases is at a high temperature and said gaskets comprise a high temperature resistant polymer.

5. The heat exchanger of claim 1 wherein said frame edge members have sloped mitered cooperating surfaces whereby said clamp means in combination with said mitered surfaces draw the frame members closer together due to the mitered construction to apply increasing pressure to the gaskets as the clamp means are tightened.

6. The heat exchanger of claim 5 wherein said passages for said first and second gases are arranged at right angles to each other, at least one of said gases is at a high temperature and said gaskets comprise a high temperature resistant polymer.

7. The heat exchanger of claim 1 wherein there are provided a plurality of said units, means for arranging said units in spaced relationship with the respective gas flow paths interconnected, the gas flow paths between said spaced units being defined in part by removable panels in order to provide access to the spaces between the plurality of units as for cleaning.

8. The heat exchanger of claim 7 wherein said frame edge members have sloped mitered cooperating surfaces whereby said clamp means in combination with said mitered surfaces draw the frame members closer together due to the mitered construction to apply increasing pressure to the gaskets as the clamp means are tightened.

9. The heat exchanger of claim 8 wherein said passages for said first and second gases are arranged at right angles to each other, at least one of said gases is at a high temperature and said gaskets comprise a high temperature resistant polymer.

* * * * *